US006088867A

United States Patent [19]

Stefani et al.

[11] Patent Number: 6,088,867

[45] Date of Patent: Jul. 18, 2000

[54] COMBINED MOP AND BRUSH ASSEMBLY

[76] Inventors: Sheri Stefani, 3 N 774 Rte. 59, West Chicago, Ill. 60185; Lynn Dulceak, 3012 Solitude La., Aurora, Ill. 60504

[21] Appl. No.: 09/191,221

[22] Filed: Nov. 13, 1998

[51] Int. Cl.[7] ..... A47L 13/12; A47L 13/144

[52] U.S. Cl. ..... 15/115; 15/116.1

[58] Field of Search ..... 15/115, 116.1, 15/105

[56] References Cited

U.S. PATENT DOCUMENTS

| | | |
|---|---|---|
| 732,742 | 7/1903 | Held . |
| 908,791 | 1/1909 | Mason . |
| 3,964,121 | 6/1976 | Kim . |
| 4,392,269 | 7/1983 | Nishiyama et al. . |
| 5,522,110 | 6/1996 | Borofsky . |
| 5,584,091 | 12/1996 | Borofsky . |
| 5,706,544 | 1/1998 | Young . |

*Primary Examiner*—Randall E. Chin
*Attorney, Agent, or Firm*—Thomas R. Vigil

[57] ABSTRACT

The combined mop and brush assembly comprises: an elongate mop and brush handle; a mop strand holder, with mop strands mounted therein, mounted on a lower end portion of the mop and brush handle; and a generally cylindrical brush mounted to the lower distal end of the mop and brush assembly handle with the axis of the cylinder being generally coaxial with the mop and brush handle or a generally spherical brush mounted to the lower distal end the mop and brush holder beneath the mop strand holder. If desired, a mop strand squeegee assembly can be mounted on the mop and brush handle.

20 Claims, 3 Drawing Sheets

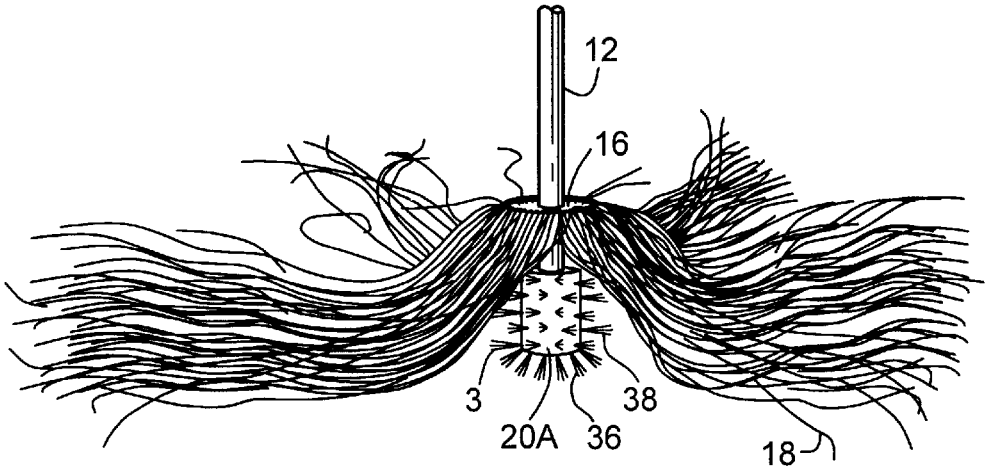
FIG. 1
FIG. 2
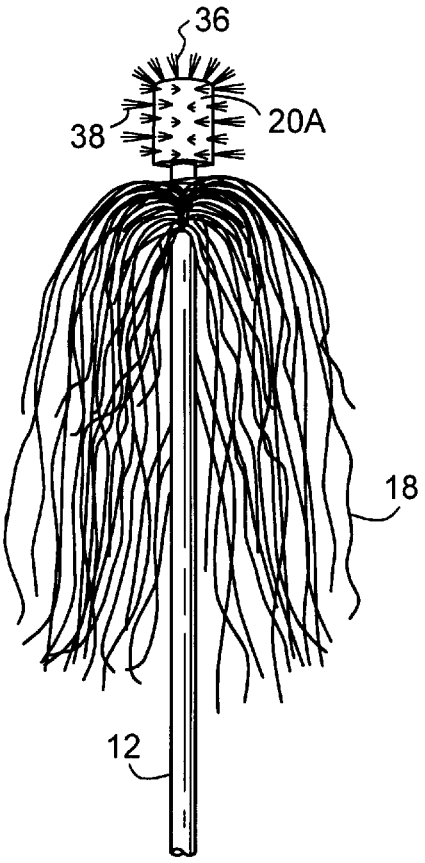
FIG. 3
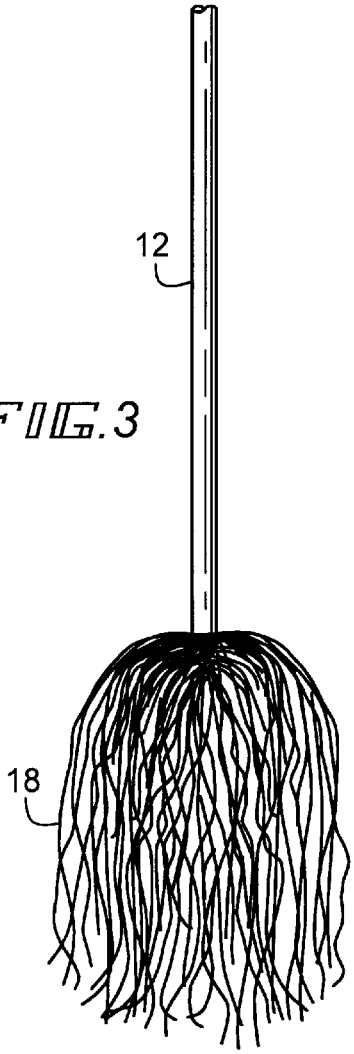

COMBINED MOP AND BRUSH ASSEMBLY

BACKGROUND OF THE INVENTION

1. Field of the Invention

The present invention relates to a combined mop and brush assembly for cleaning a floor surface. More specifically, the present invention relates to a simple combined mop and brush assembly which includes mop strands mounted in a mop strand holder and a generally cylindrical or generally spherical brush extending from the lower end of the mop strand holder for scrubbing a floor surface.

2. Description of the Related Art Including Information Disclosed Under 37 CFR §§ 1.97–1.99

Heretofore a number of combined mop and brush assemblies have been proposed for scrubbing a floor or a sink. Examples of these previously proposed combined mop and brush assemblies are disclosed in the following U.S. patents:

| U.S. Pat. No. | Patentee |
|---|---|
| 732,742 | Held |
| 908,791 | Mason |
| 3,964,121 | Kim |
| 4,392,269 | Nishiyama et al. |
| 5,522,110 | Borofsky |
| 5,584,091 | Borofsky |
| 5,706,544 | Young |

SUMMARY OF THE INVENTION

According to the present invention there is provided a combined mop and brush assembly comprising: an elongate mop and brush handle; a mop strand holder, with mop strands mounted therein, mounted on a lower end portion of the mop and brush handle; and a generally cylindrical brush mounted to the lower distal end of the mop and brush assembly handle with the axis of the cylinder being generally coaxial with the mop and brush handle or a generally spherical brush mounted to the lower distal end the mop and brush holder beneath the mop strand holder.

BRIEF DESCRIPTION OF THE DRAWINGS

FIG. 1 is a perspective view of the mop and brush assembly of the present invention with the mop strands spread out to show a generally cylindrical brush of the assembly.

FIG. 2 is an inverted perspective view of the mop and brush assembly of the present invention with the mop strands extending downwardly along a mop handle.

FIG. 3 is a perspective view of the mop and brush assembly of the present invention in a raised position from the position shown in FIG. 1 such that the mop strands extend over and hide the generally cylindrical brush from view.

DESCRIPTION OF THE PREFERRED EMBODIMENT(S)

Figure 6:
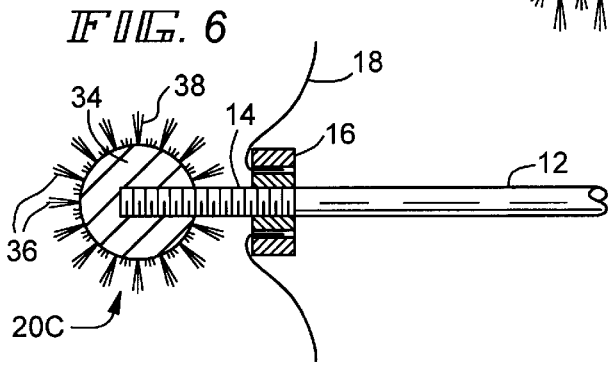
FIG. 6 is a plan view of the assembled mop and brush assembly of the present invention with portions in section and showing a spherical brush at the distal end of the mop handle.
Figure 7:
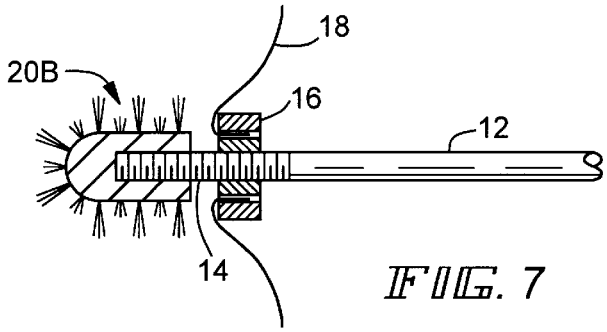
FIG. 7 is an assembled plan view of the mop and brush assembly of the present invention with portions in section and showing a rounded distal end cylindrical brush mounted at the distal end of the mop handle.

Referring now to the drawings in greater detail, there is illustrated in FIG. 1 a mop and brush assembly 10 of the present invention which includes an elongate mop and brush handle 12 that is threaded at its lower distal end 14 (FIG. 4), a generally annular mop strand holder 16 (FIG. 4), which has a plurality of mop strands 18 extending therefrom, threadably received on the mop and brush handle and a generally cylindrical brush 20A (FIG. 1) or generally spherical brush 20C (FIG. 6) mounted at the lower distal end 14 of the mop and brush handle 12 below the mop strand holder 16.

Figure 4:
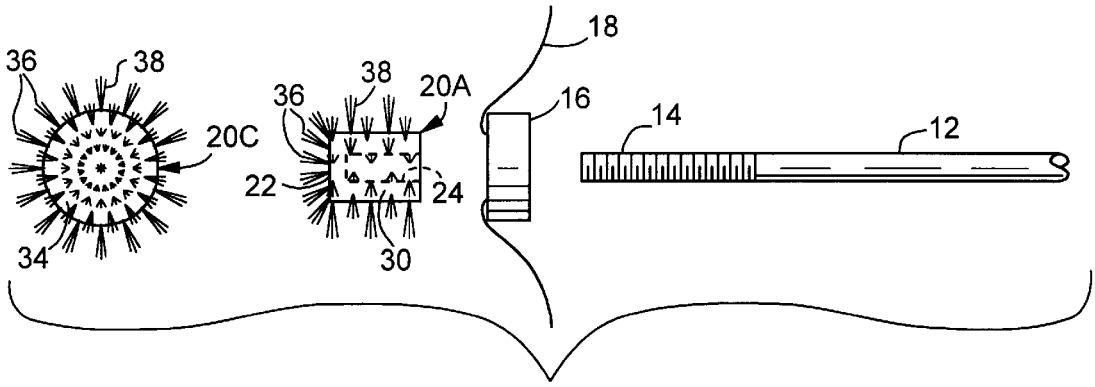
FIG. 4 is an exploded perspective view of a mop handle, a mop strand holder, a generally cylindrical brush and a generally spherical brush.
Figure 5:
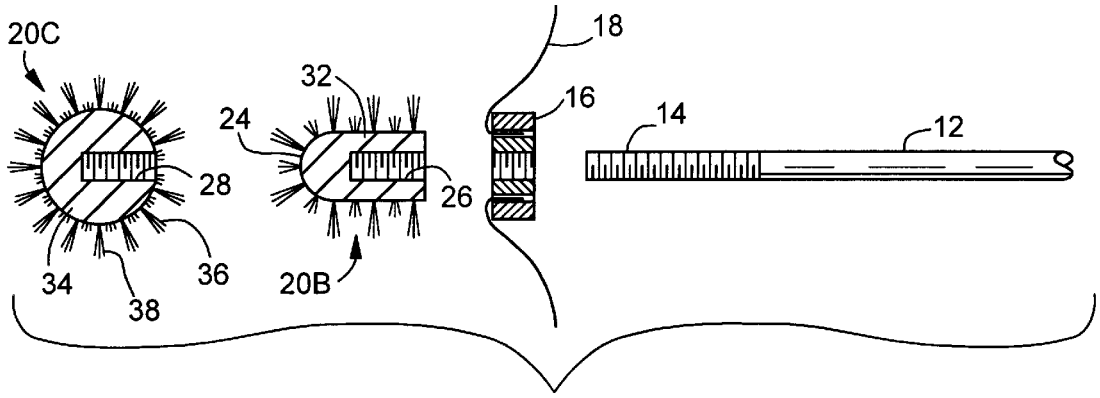
FIG. 5 is an exploded perspective view of the mop and brush assembly shown in FIG. 4, except that the mop strand holder, the cylindrical brush and the spherical brush are shown in section and the cylindrical brush is shown with a rounded distal end.

As shown in FIGS. 4 and 5, the brush 20A or 20B is generally cylindrical with a flat end 22 or, if desired, can be a generally cylindrical brush 20B (FIG. 5) which has a rounded outer end 24. The axis of the generally cylindrical brush 20A or 20B is generally coaxial with the axis of the mop and brush handle 12 and preferably has a bore 26 therein for threadably receiving the lower end 14 of the mop and brush handle 12.

In the case of the spherical brush 20C, a bore 28, generally on a diameter or radius of the spherical brush 20C, is threaded at 28 for threadably receiving the lower end 14 of the mop and brush handle 12.

As shown in FIGS. 1, 2 and 4–7, the brushes 20A and 20B include a generally cylindrical body 30 or 32 and the brush 20C has a generally spherical body 34. The bodies 30, 32 and 34 all have spaced apart tufts 36 of bristles 38 of brush material, which can be plastic or organic, extending from the outer surface thereof, i.e., from the cylindrical surface of the brushes 20A and 20B, from the flat front end surface 22 of the brush 20A, from the rounded end 24 of the brush 20B or from the spherical surface of the brush 20C. These tufts 36 enable one to scrub cracks and corners with the tufts with no special orientation of the mop and brush assembly 10 being required.

Furthermore, the simple threaded arrangement of the distal end 14 of the mop and brush handle 12, the mop strand holder 16 and each of the brushes 20A, 20B or 20C provide a very simple arrangement for assembling the components of the mop and brush handle assembly 10 as shown in FIGS. 4–7 where it will be seen that, first the annular mop strand holder 16, having the mop strands 18 fixed in an axially facing annular groove, is threaded onto the mop handle 16.

Then, the brush 20A, 20B or 20C is threaded onto the end of 14 of the mop and brush handle 12.

Figure 8:
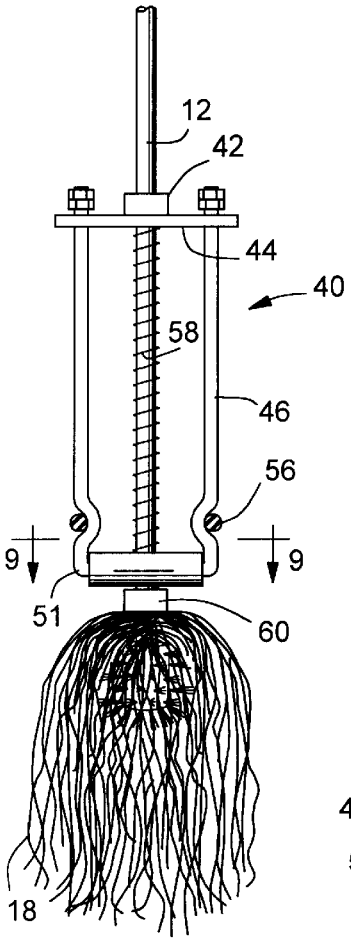
FIG. 8 is a front elevational view of the mop and brush assembly of the present invention with a mop squeegee assembly mounted on the mop handle of the mop and brush assembly.

If desired, a squeegee assembly 40 can be mounted on the mop and brush handle 12 for squeezing water or other liquid out of the mop strands 18 as shown in FIGS. 8–12. Such squeegee assembly 40 comprises a stop member 42 mounted on the mop and brush handle 12, a plate 44 having a throughbore for enabling the plate 44 to be received over the mop and brush handle 12 beneath the stop member 42, three U shaped frame members 46, 48 and 50 each being fixed to and each extending downwardly from the plate 44 to a bight portion 51, each mounting a squeegee roller 54, an elastic band 56 extending around the U shaped frame members 46, 48 and 50 as shown in FIGS. 8 and 10–12 and a coiled spring 58 extending between the bottom of the plate 44 and a lower stop member 60 on top o f the mop strand holder for biasing the squeegee assembly 40 upwardly as shown in FIG. 8.

Figure 9:
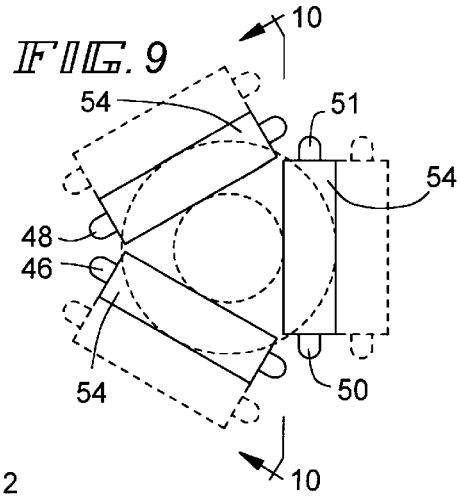
FIG. 9 is a sectional view of three squeegee rollers of the squeegee assembly shown in FIG. 8 and is taken along line 9—9 of FIG. 8
Figure 10:
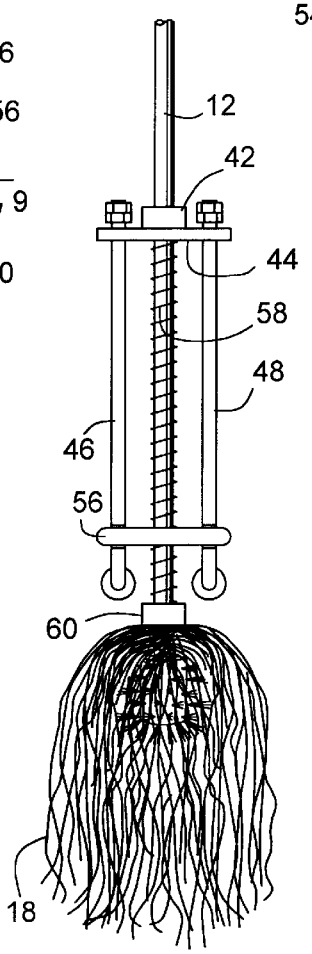
FIG. 10 is a side elevational view of the mop and brush assembly together with the squeegee assembly and is taken along line 10—10 of FIG. 9.
Figure 11:
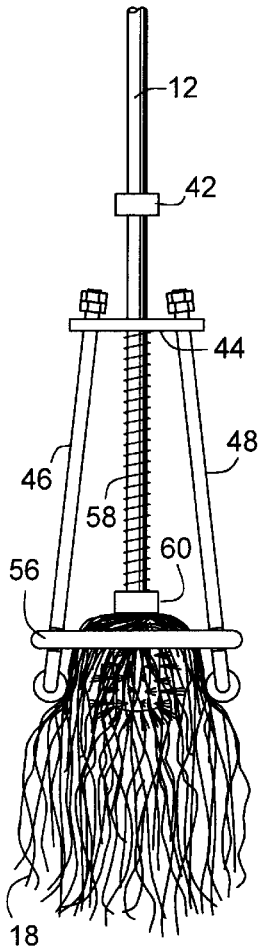
FIG. 11 is a side elevational view similar to FIG. 10 but showing the squeegee assembly moved down over the mop and brush.
Figure 12:
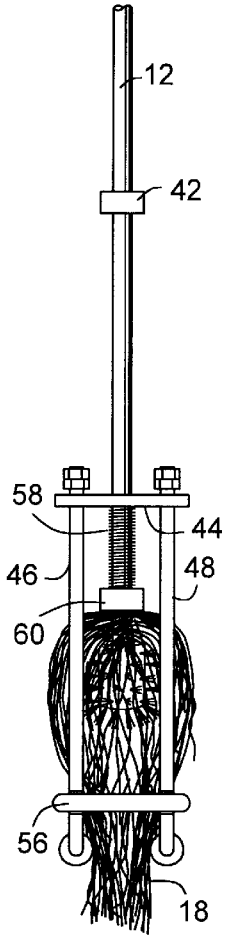
FIG. 12 is a side elevational view similar to FIG. 11 showing the squeegee assembly moved further down over the brush and mop and engaging only the mop.

As shown in FIGS. 10, 11 and 12 a user would push the plate 44 downwardly against the action of the coiled spring 58 to cause the three rollers 54 to engage the mop strands 18 extending over the brush 20A or 20B as shown in FIGS. 9–12. When the rollers 54 are over the brush 20A OR 20B, they will be displaced outwardly, as shown in FIG. 9, causing stretching of the elastic band 56. This is best shown in FIGS. 9 and 11.

Then, when the squeegee assembly 40 is pushed further downwardly, the rollers 54 will then go beneath the brush 20A OR 20B and engage the lower portions of the mop strands, as shown in FIG. 12.

Of course, it will be understood that, releasing pressure on the plate 44 will allow the plate 44 to move upwardly against the action of the coiled spring 58 back to the upper stop member 42 and, thereby, move the squeegee assembly 40 upwardly over the mop strands 18 and the brush 20A OR 20B.

From the foregoing description, it will be apparent that the mop and brush handle assembly 10 of the present invention has a number of advantages some of which have been described above and others of which are inherent in the invention. Accordingly, the scope of the invention is only to be limited as necessitated by the accompanying claims.

We claim:

1. A combined mop and brush assembly comprising:

an elongate mop and brush handle;

a mop strand holder, with mop strands mounted therein, mounted on a lower end portion of said mop and brush handle; and a generally cylindrical brush mounted at the lower distal end of the mop and brush handle beneath said mop strand holder with the axis of the generally cylindrical brush being generally coaxial with said mop and brush handle.

2. The combined mop and brush assembly of claim 1 wherein said generally cylindrical brush is flat at its outer distal end.

3. The combined mop and brush assembly of claim 1 wherein said generally cylindrical brush is rounded at its outer distal end.

4. The combined mop and brush assembly of claim 1 wherein said generally cylindrical brush comprises a body having a bore therein which receives said lower end portion of said mop and brush handle.

5. The combined mop and brush assembly of claim 4 wherein said bore in said body is threaded for receiving a threaded lower end of said mop and brush handle.

6. The combined mop and brush assembly of claim 4 wherein tufts of bristles of brush material are mounted on an outer cylindrical surface of said brush body and arranged to extend outwardly from said cylindrical surface of the brush body.

7. The combined mop and brush assembly of claim 1 wherein said lower end of said elongate mop and brush handle is threaded, said mop strand holder includes a generally annular body with a throughbore therethrough which is threaded and said generally cylindrical brush includes a brush body having a threaded bore extending axially into said brush body for receiving said threaded lower end of said mop and brush handle.

8. The combined mop and brush assembly of claim 1 further comprising a squeegee assembly mounted on said mop and brush handle and including means for enabling the squeegee assembly to move downwardly over the mop and brush handle to squeeze liquid out of said mop strands and subsequently to be returned to a position above said mop and said brush.

9. The combined mop and brush assembly of claim 8 wherein said squeegee assembly includes at least two U shaped frame members having upper ends of the legs thereof mounted to a plate positioned on said mop and brush handle, each said U shaped frame member having at a lower end thereof on a bight portion thereof, a roller, the U-shaped frame members being held closely adjacent to said mop and brush handle by a continuous elastic band surrounding said U shaped frame members and being movable downwardly and upwardly to squeeze liquid out of said mop strands.

10. The combined mop and brush assembly of claim 9 including an upper stop member mounted on said mop and brush handle to limit upward movement of said plate and a spring extending between said plate and a lower stop member mounted above the mop and brush on the mop and brush handle.

11. A combined mop and brush assembly comprising:

an elongate mop and brush handle;

a mop strand holder, with mop strands mounted therein, mounted on a lower end portion of said mop and brush handle; and a generally spherical brush mounted at the lower distal end of the mop and brush assembly handle beneath said mop strand holder.

12. The combined mop and brush assembly of claim 11 wherein a diameter of said generally spherical brush is generally coaxial with an elongate axis of said mop and brush handle.

13. The combined mop and brush assembly of claim 11 wherein said brush comprises a body having a threaded bore therein which receives a threaded lower end of said mop and brush handle.

14. The combined mop and brush assembly of claim 11 wherein said generally spherical brush includes a generally spherical body with spaced tufts of bristles of brush material being mounted to an outer surface of said generally spherical body and arranged to extend outwardly from said spherical body.

15. The combined mop and brush assembly of claim 11 wherein said lower end of said elongate mop and brush handle is threaded, said mop strand holder includes a generally annular body with a throughbore therethrough which is threaded and said generally spherical brush includes a generally spherical brush body having a threaded bore extending axially into said brush body for receiving said threaded lower end of said mop and brush handle.

16. The combined mop and brush assembly of claim 11 wherein said mop and brush handle is threaded at a lower end thereof and said generally spherical brush includes a generally spherical body which has a bore threaded for receiving the lower end of the mop and brush handle.

17. The combined mop and brush assembly of claim 16 wherein said bore in said spherical body is on a radius of the spherical body.

18. The combined mop and brush assembly of claim 11 further comprising a squeegee assembly mounted on said mop and brush handle and including means for enabling the squeegee assembly to move downwardly over the mop and brush handle to squeeze liquid out of said mop strands and subsequently to be returned to a position above said mop and said brush.

19. The combined mop and brush assembly of claim 18 wherein said squeegee assembly includes at least two U shaped frame members having upper ends of the legs thereof mounted to a plate positioned on said mop and brush handle, each said U shaped frame member having at a lower end thereof on a bight portion thereof, a roller, the U-shaped frame members being held closely adjacent to said mop and brush handle by a continuous elastic band surrounding said U shaped frame members and being movable downwardly and upwardly to squeeze liquid out of said mop strands.

20. The combined mop and brush assembly of claim 19 including an upper stop member mounted on said mop and brush handle to limit upward movement of said plate and a spring extending between said plate and a lower stop member mounted above the mop and brush on the mop and brush handle.

* * * * *